United States Patent [19]

Creamer

[11] 4,438,628

[45] Mar. 27, 1984

[54] PUMP JACK DRIVE APPARATUS

[76] Inventor: Reginald D. Creamer, 228 Spring Haven Ct., Airdrie, Alberta, Canada

[21] Appl. No.: 218,038

[22] Filed: Dec. 19, 1980

[51] Int. Cl.[3] ..... F04B 35/00

[52] U.S. Cl. ..... 60/374; 60/383; 60/476; 91/183; 91/275; 91/306

[58] Field of Search ..... 60/369, 372, 374, 383; 91/178, 179, 182, 183, 185, 275, 305, 306; 417/399

[56] References Cited

U.S. PATENT DOCUMENTS

| | | | |
|---|---|---|---|
| 2,200,790 | 5/1940 | Eckert | 91/179 |
| 2,803,110 | 8/1957 | Chittenden | 91/275 |
| 3,128,675 | 4/1964 | Dulaney | 91/178 X |
| 3,620,126 | 11/1971 | Fuhrimann | 91/306 X |
| 4,050,356 | 9/1977 | Jaggi | 91/306 |
| 4,114,375 | 9/1978 | Saruwatari | 60/372 |
| 4,201,115 | 5/1980 | Ogles | 60/369 X |

*Primary Examiner*—Robert G. Nilson

*Attorney, Agent, or Firm*—Harold H. Dutton, Jr.; George H. Dunsmuir

[57] ABSTRACT

A pump jack drive apparatus includes a pair of hydraulic cylinders connected to a walking beam of the pump jack for reciprocating the horsehead, and a pair of microswitches or proximity switches which are closed by the walking beam at the limits of the stroke thereof for controlling such stroke. The cylinders are driven and controlled by a pump and control unit which includes a valve for feeding hydraulic fluid to one or the other of the hydraulic cylinders, a control cylinder for controlling the valve, and two solenoid operated control valves for controlling movement of the control cylinder in response to closing of the switches by the walking beam.

1 Claim, 6 Drawing Figures

PUMP JACK DRIVE APPARATUS

BACKGROUND OF THE INVENTION

This invention relates to a pump jack drive apparatus, and in particular to an apparatus for driving and controlling the speed of operation of a pump jack.

There are presently available a number of alternative forms of pump for pumping oil. Because of their unreliability and expense, such pumps have not replaced the conventional pump jack in oilfields. The pumping of heavy oils presents certain problems. If such problems can be overcome, the production of heavy oils can be substantially increased.

The motion of the walking beam of a conventional pump jack is derived from a rotating eccentric. The stroke cycle is normally fixed and resembles a sine wave. In order to pump efficiently, the pumping cycle cannot be changed. When pumping heavy oil, the pumping cycle may be altered which is one of the problems referred to above. In the production of heavy oils, it is advantageous (1) to be able to change the rate of pumping and stroking profile, or (2) to be able to maintain the rate of pumping constant at a predetermined level.

Because of the relatively low production rates of heavy oil, the equipment used to control pumping with a pump jack should be inexpensive and reliable. The object of the present invention is to meet such demands by providing a relatively simple, inexpensive apparatus for driving and controlling operation of a pump jack.

SUMMARY OF THE INVENTION

Accordingly, the present invention relates to a driving apparatus for a pump jack of the type including a samson post, a walking beam pivotally mounted on the samson post for rotation around a horizontal axis, a horsehead on one end of the walking beam for driving connection to a pump mechanism, said apparatus comprising first cylinder means pivotally mounted on said samson post; first piston rod means associated with said first cylinder means and pivotally connected to said walking beam on one side of said horizontal axis for moving said one end of said walking beam downwardly; and control means for alternately operating said first and second cylinder means independently of each other, whereby said one end of the walking beam and said horsehead are reciprocated upwardly and downwardly, the upward and downward movements being at the same or different speeds.

BRIEF DESCRIPTION OF THE DRAWINGS

The invention will now be described in greater detail with reference to the accompanying drawings, which illustrate a preferred embodiment of the invention, and wherein.

DESCRIPTION OF THE PREFERRED EMBODIMENTS

Figure 2:
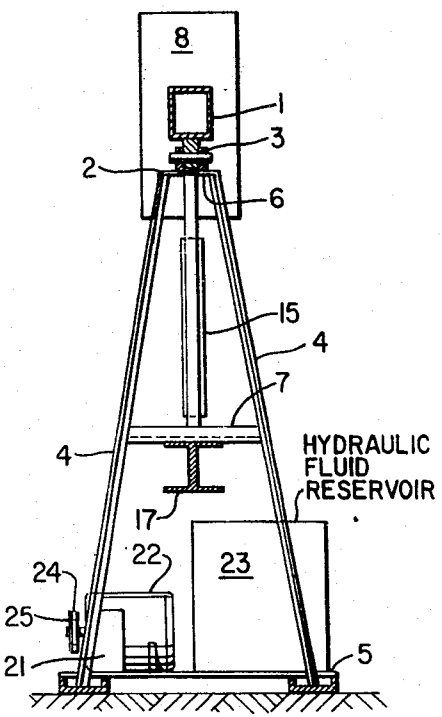
FIG. 2 is a cross-sectional view taken generally along line II—II of FIG. 1.
Figure 1:
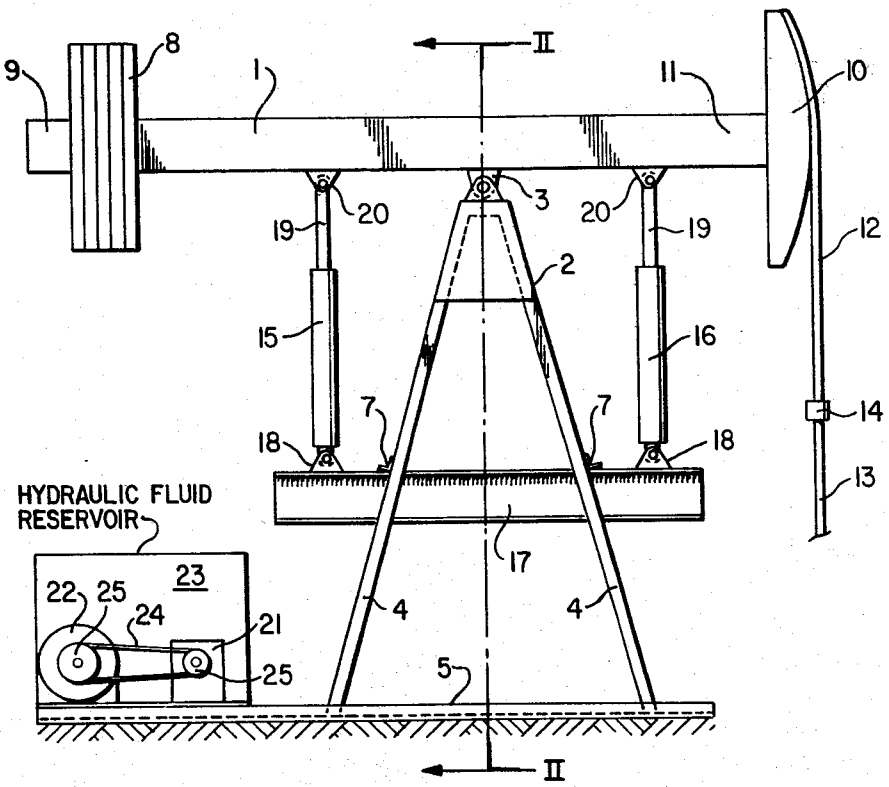
FIG. 1 is a side elevation view of a pump jack and drive apparatus in accordance with the present invention.

With reference to FIGS. 1 and 2, the apparatus of the present invention is intended for use with a conventional pump jack of the type including a walking beam 1, pivotally mounted on the top of a samson post 2 for rotation around a horizontal axis defined by a saddle bearing 3. The samson post 2 includes four inclined legs 4 extending upwardly from a base 5, a top plate 6 and crossbars 7 extending between the legs 4 at the front and rear ends of the post 2. A counterweight 8 is mounted on rear end 9 of the walking beam 1, and a horsehead 10 is mounted on the front end 11 of such beam. A wire line assembly or wire rope bridel 12 is connected at one end to the horsehead 10 and at the other end to a pump mechanism, including a polished rod 13. The bail 12 and rod 13 are connected by a connector 14. Usually, the polished rod 13 reciprocates a sucker pod or pump rod associated with a downhole pump (not shown).

In conventional pump jacks, the walking beam is caused to rotate around the samson post 2 by means of a pitman assembly (not shown) connected to the rear end 9 of the beam. In the case of the present invention, the walking beam 1 is driven by means of hydraulic cylinders 15 and 16 connected to the rear and front ends 9 and 11, respectively of the walking beam. The bottom ends of the hydraulic cylinders 15 and 16 are pivotally connected to an I-beam 17 by clevises 18. The I-beam 17 is supported by the crossbars 7. Piston rods 19 extend upwardly from the top ends of the cyliners 15 and 16 to the walking beam 1. The top ends of the piston rods 19 are pivotally connected to the walking beam 1 by clevises 20.

The hydraulic cylinders 15 and 16 are operated by a hydraulic pump 21, which is driven by a prime mover in the form of motor 22. Hydraulic fluid is stored in hydraulic fluid reservoir 23. The pump 21, the motor 22 and the reservoir 23 are mounted on the rear end of the base 5. A V-belt 24 passes around pulleys 25 on the motor 22 and the pump 21, respectively.

Figure 3:
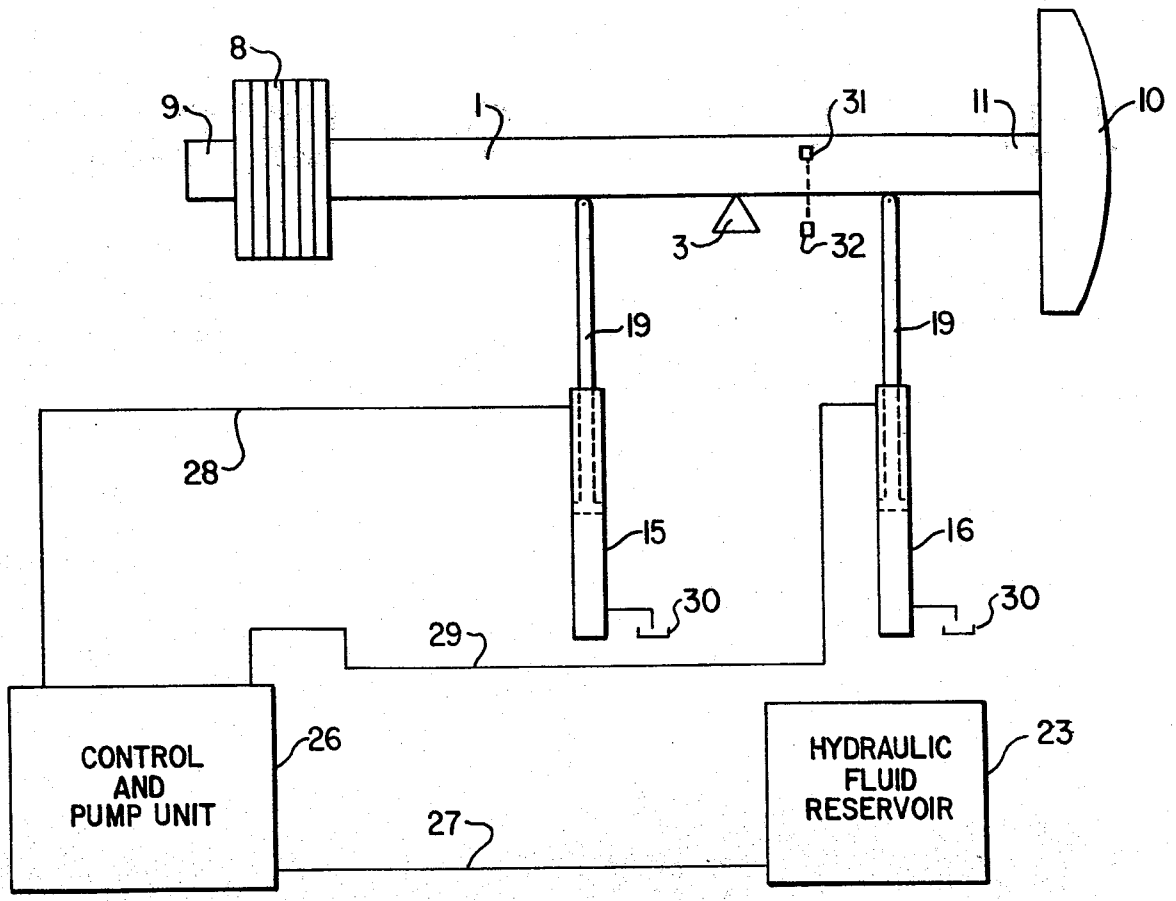
FIG. 3 is a schematic block diagram of the basic elements of the pump jack and drive apparatus of FIGS. 1 and 2.

With reference to FIG. 3, the hydraulic circuit for operating the cylinders 15 and 16 includes the reservoir 23, which is connected to a control and pump unit 26 by a line 27, lines 28 and 29 for supplying hydraulic fluid to the cylinders 15 and 16, respectively, and sumps 30. The upper and lower limits of travel of the front end 11 of the walking beam 1 are determined by microswitches or proximity switches 31 and 32, respectively. The switches 31 and 32 are mounted on an arm (not shown) extending upwardly from the samson post 2 in positions such that they are closed by the walking beam 1 or by a lug or magnet (not shown) projecting outwardly therefrom. By adjusting the positions of the switches 31 and 32, the vertical travel of the ends of the walking beam 1 and of the horsehead 10 can be changed.

Figure 4:
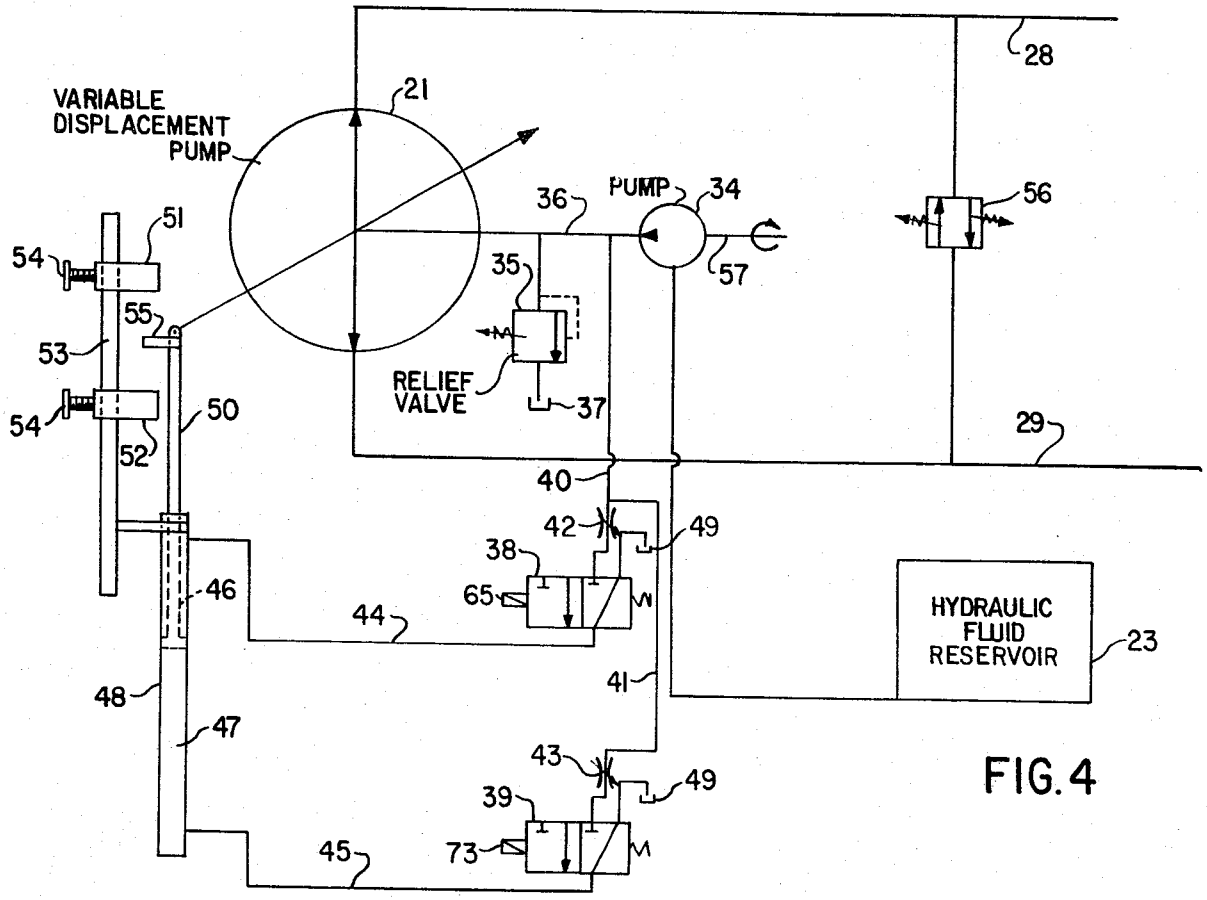
FIG. 4 is a schematic block diagram of a control system used in the drive apparatus of the present invention.

Referring now to FIG. 4, in one form of control system of the apparatus of FIGS. 1 to 3, the pump 21 is a variable displacement pump, which is used in conjunction with a fixed displacement pump 34. The pressure of hydraulic fluid (oil) pumped from the reservoir 23 by the pump 34 is kept at constant pressure, normally approximately 250 psi, by a relief valve 35 which is connected to line 36 between the pumps 22 and 34, and to sump 37. Fluid from the pump 34 supplies the pump 21 and the control system. Control of the pump 22 and thus of movements of the rods 19 and the walking beam 1 is achieved by means of solenoid operated valves 38 and 39, which receive fluid from the pump 34 via lines 40 and 41, respectively, and needle valves 42 and 43, respectively. The valves 38 and 39 and lines 44 and 45 connect top end 46 or bottom end 47, respectively of a hydraulic control cylinder 48 to the pump 34 or to a sump 49. Piston rod 50 of the cylinder 48 is connected to the pump 21 for controlling operation thereof. The limits of movement of the rod 50 are controlled by stops 51 and 52 movably mounted on an arm 53 connected to the cylinder 48. Screws 54 are used to fix the positions of the stops 51 and 52 on the arm 53. The stops 51 and 52 are contacted by a lug 55 on the outer end of the piston rod 50. Damage to the apparatus is prevented by a relief valve 56 between the lines 28 and 29.

Figure 5:
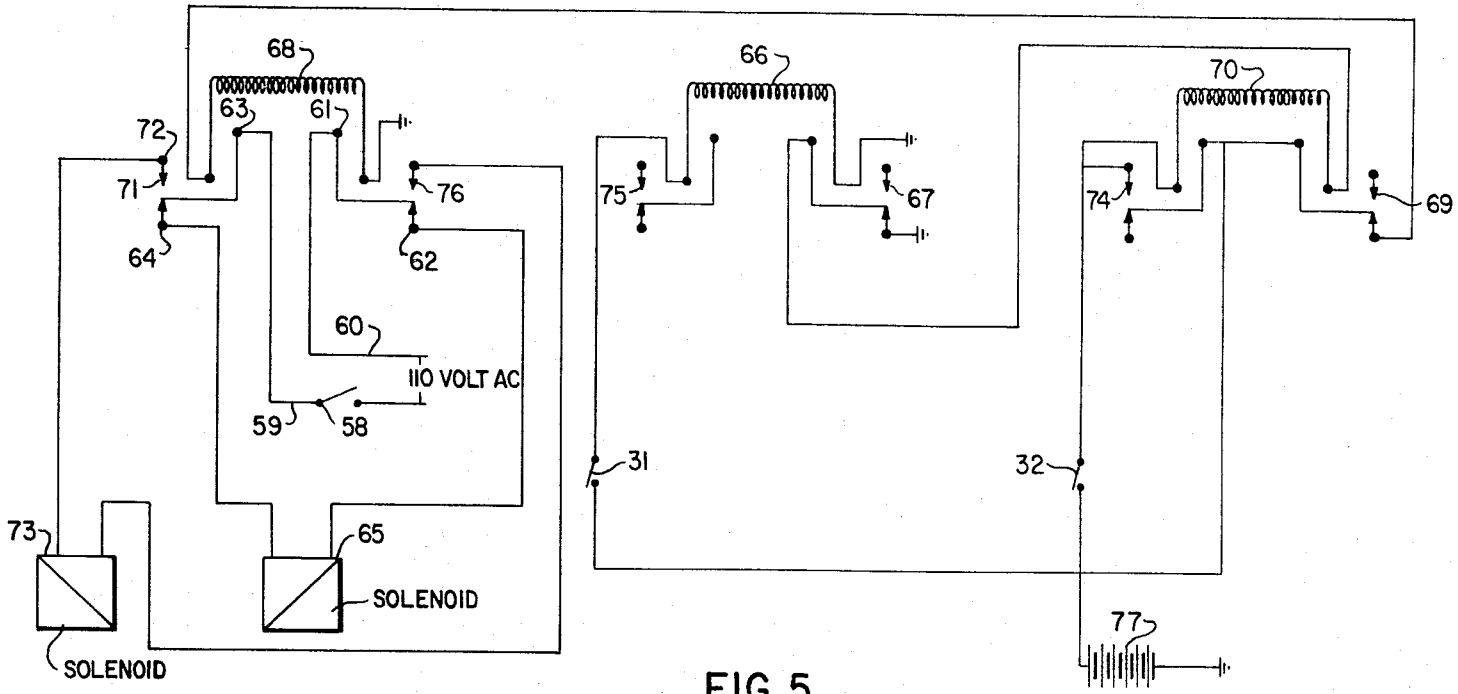
FIG. 5 is a schematic block diagram of an electrical circuit used in the apparatus of FIGS. 1 to 4.

In operation, the motor 22 is started to also start the pumps 21 and 34. The pump 34, which is a fixed displacement pump, is connected to the motor 22 by drive shaft 57. With the motor 22 running, the pump 34 begins to deliver fluid to the pump 21 and the remainder of the control system. Fluid is delivered to the solenoid valves 38 and 39 under charge pressure. With starting switch 58 (FIG. 5) open, fluid is stopped at the valves 38 and 39. When the starting switch 58 is closed, current flows through lines 59 and 60, and terminals 61, 62, 63, and 64 to energize solenoid 65 of the valve 38. The lines 59 and 60 are connected to a 110 volt AC source of power. Thus, fluid from the pump 34 flows through lines 40 and 44 to the top end 46 of the control cylinder 48. The rod 50 is retracted and hydraulic fluid is delivered from the cylinder 16 via line 29 to the pump 21, while fluid is pumped through the line 28 to the cylinder 15. This causes the horsehead 10 to move upwardly.

At the top of the stroke of the walking beam 1, the microswitch 31 is closed which energizes relay 66, breaking contact 67 and causing an interruption in power to the coil of the relay 68. Such interruption closes a contact 69 and energizes relay 70 which flips contact 71 from closing terminals 63-64 to closing terminals 72-63. Thus, solenoid 73 of the valve 39 is energized and the solenoid 65 is de-energized. Hydraulic fluid then flows through the valve 39 and lines 41 and 45 to the bottom 47 of the cylinder 48, while fluid from the top 46 of the cylinder passes through line 44 and the valve 38 to sump 49. The pump 21 operates to pump hydraulic fluid through the line 29 to the top of the cylinder 16 while fluid is withdrawn from the top of the cylinder 15 through the line 28. The horsehead 10 then travels downwardly. When the bottom limit of travel of the horsehead 10 is reached, the microswitch 32 is closed to reverse the power to the solenoids 65 and 75 using contacts 74, 75, and 76. It will be noted that the relays 66, 68 and 70 are powered by a 12 volt DC battery 77.

The speed of movement of the rods 19 in the cylinders 15 and 16 is controlled by the spacing of the stops 51 and 52. If the stops 51 and 52 are placed farther apart, then fluid is pumped more rapidly into the top of the cylinder 15 or 16 and withdrawn more rapidly from the top of the other cylinder. Thus, the stop 52 controls the speed of the pump jack, i.e., of the horsehead 10 upwardly, and the stop 51 controls the speed downwardly. Acceleration of the pump jack is effected by increasing the rate of travel of the rod 50 in the cylinder 48. The needle valves 42 and 43 control the rate of feed of hydraulic fluid to the cylinder 48, and thus control the rate of movement of the rod 50, which in turn controls the rate of change of fluid displacement through the pump 21. The valve 42 controls acceleration at the bottom of the stroke and the valve 43 controls acceleration at the top of the stroke of the pump jack.

Figure 6:
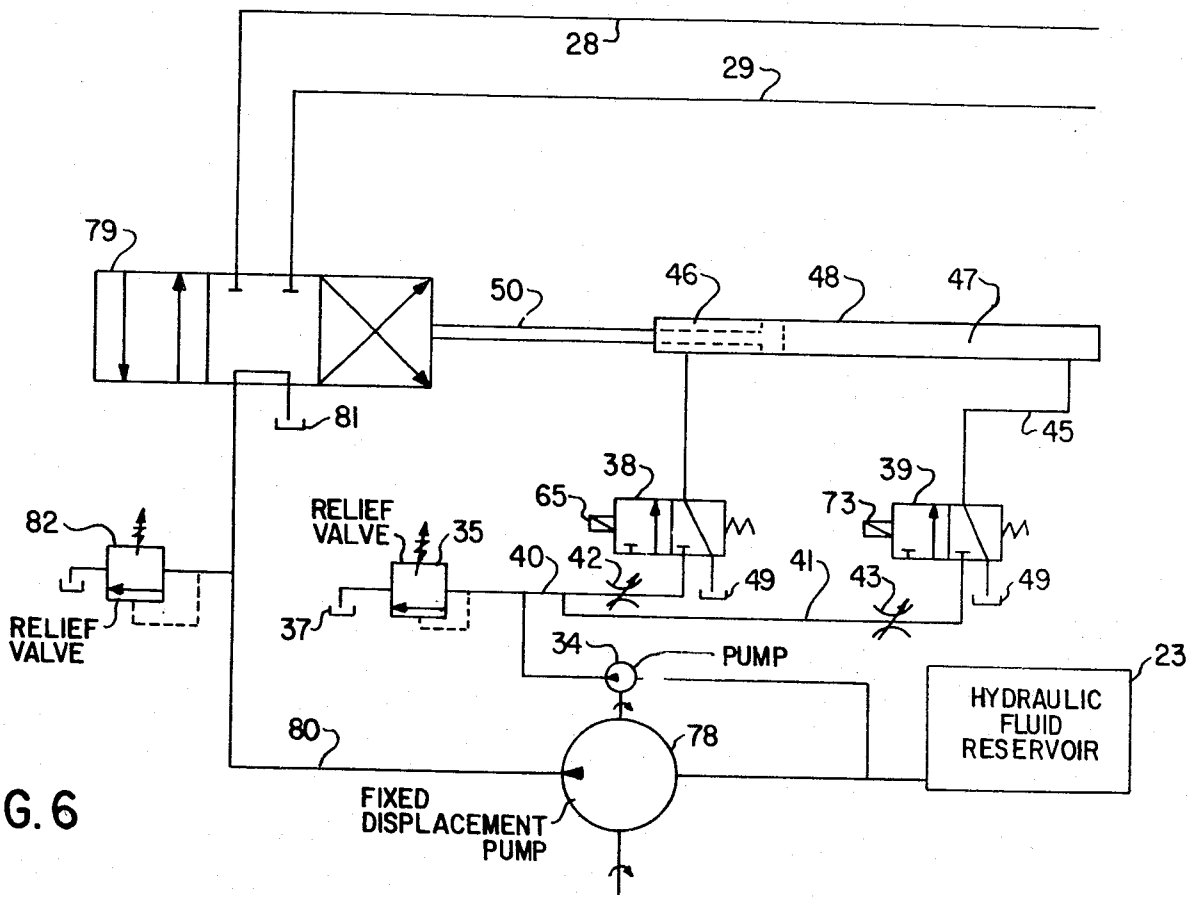
FIG. 6 is a block diagram of a second form of control system for use in the apparatus of FIGS. 1 to 3.

Referring now to FIG. 6, a control system utilizing a fixed displacement pump will now be described. In situations where there is no need for easy adjustment of the speed of operation of the pump jack, a fixed displacement pump 78 can be used, with a resulting saving in costs. The ratio of the speed of movement of the rods 19 upwardly and downwardly and thus the speed of the horsehead 10 can be adjusted by changing the diameter of the cylinders 15 and 16. For example, since the hydraulic fluid is supplied at a constant rate, if the diameter of the cylinder 15 is twice that of the cylinder 16, the pump jack will move downwardly four times more quickly than upwardly. The overall speed of the pump jack is determined by the size and speed of operation of the pump 78.

The control system of FIG. 6 is essentially the same as that of FIG. 4, and wherever possible, the same reference numerals have been used to identify the same or similar elements.

The operation of the control system of FIG. 6 is the same as that of FIG. 4, except that the outer end of the piston rod 50 of the cylinder 48 is connected to a valve 79, which is connected directly to the pump 78 by a line 80 and to the lines 28 and 29 for carrying hydraulic fluid to the cylinders 15 and 16 or to sump 81. A relief valve 82 is connected to the line 80. Movement of the rod 50 following opening of one of the valves 38 and 39 results in movement of the valve 79 to a position in which fluid flows to cylinder 15 or 16, and fluid is returned to sump 81 from the other cylinder.

The advantages of the apparatus described hereinbefore are many. By eliminating the conventional drive assembly which includes a gearbox, the horsehead can be driven upwardly and downwardly at different rates, i.e., the horsehead can ascend more quickly than it descends. The speed of operation of the pump jack is relatively easy to adjust with the apparatus of the present invention. Because the stroke pattern is not necessarily sinusoidal, forces and peak velocities are reduced with increases efficiency.

By locating the drive cylinders close to the fulcrum of the walking beam, piston rod movement is decreased, and thus cylinder life is increased. Hydraulic pumps presently in use require a ratio of cylinder rod movement to polished rod movement of 1:1.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example, equivalent elements may be substituted for those illustrated and described herein, parts may be used independently of the use of other features, all as will be apparent to one skilled in the art after having the benefits of the description of the invention.

What I claim is:

1. A driving apparatus for a pump jack of the type including a samson post, a walking beam pivotally mounted on the samson post for rotation around a horizontal axis, a horsehead on one end of the walking beam for driving connection to a pump mechanism, said apparatus comprising first cylinder means pivotally mounted on said samson post; first piston rod means associated with said first cylinder means and pivotally connected to said walking beam on one side of said horizontal axis for moving said one end of said walking beam upwardly upon extension of said first piston rod means with respect to said first cylinder means; second cylinder means pivotally mounted on said samson post; second piston rod means associated with said second cylinder means and pivotally connected to said walking beam on the other side of said horizontal axis for moving said one end of said walking beam downwardly upon extension of said second piston rod means with respect to said second cylinder means; adjustable control means for alternately extending said first and second cylinder means, said control means comprising a variable displacement pump, control piston and cylinder means mechanically connected to said variable displacement pump for controlling the operation thereof and including a pair of adjustable limit stops for said control piston and cylinder means for independently controlling the extension speed of said first and second cylinder means, a fixed displacement pump for supplying fluid under pressure to said variable displacement pump and through a pair of solenoid valves to said control piston and cylinder means, adjustable means for controlling the flow rate of fluid through said solenoid valves for independently controlling the acceleration rates of said first and second cylinder means, switch means actuated by said walking beam at the top and bottom limits of the stroke thereof, said switch means being operatively connected to said solenoid valves for controlling the operation of said solenoid valves and thereby said control piston and cylinder means and consequently the feeding direction of said variable displacement pump, whereby said one end of the walking beam and said horsehead are reciprocated upwardly and downwardly, the upward and downward movements being at the same or different speeds according to the extension speeds selected for said first and second cylinder means.

* * * * *